United States Patent [19]

Iwase et al.

[11] Patent Number: 4,568,208

[45] Date of Patent: Feb. 4, 1986

[54] PRINTER

[75] Inventors: Takayuki Iwase; Junji Shiota; Kazuo Nakamura, all of Aichi, Japan

[73] Assignee: Brother Kogyo Kabushiki Kaisha, Nagoya, Japan

[21] Appl. No.: 662,910

[22] Filed: Oct. 19, 1984

[30] Foreign Application Priority Data

Oct. 20, 1983 [JP] Japan ..... 58-196910

[51] Int. Cl.[4] ..... B41J 9/26

[52] U.S. Cl. ..... 400/166; 101/93.03

[58] Field of Search ..... 101/93.03, 93.31, 93.33, 101/93.35; 400/157.1, 157.2, 157.3, 166, 196.1, 208, 144.2

[56] References Cited

U.S. PATENT DOCUMENTS

| | | | |
|---|---|---|---|
| 3,648,602 | 3/1972 | Augerinos et al. | 101/93.31 |
| 3,788,443 | 1/1974 | Menzi | 400/157.3 |
| 4,147,438 | 4/1979 | Sandrone et al. | 400/166 X |
| 4,472,073 | 9/1984 | Valle et al. | 400/208 |

FOREIGN PATENT DOCUMENTS

| | | | |
|---|---|---|---|
| 2919209 | 11/1980 | Fed. Rep. of Germany | 400/144.2 |
| 0087080 | 5/1983 | Japan | 400/157.3 |
| 0138673 | 8/1983 | Japan | 400/157.3 |

*Primary Examiner*—Edgar S. Burr
*Assistant Examiner*—John A. Weresh
*Attorney, Agent, or Firm*—Finnegan, Henderson, Farabow, Garrett & Dunner

[57] ABSTRACT

In a printer, a printing clutch and a hammer impact changeover mechanism are controlled through a control member by one electromagnet, in such a manner that in response to a printing signal the clutch is engaged through the control member by the electromagnet to start one printing cycle and, in the second half of the printing cycle, the electromagnet is operated to enable a hammer impact change-over mechanism with the aid of the control member. The energizing forces of two weak spring members are applied to a cam follower member operatively coupled to the printing hammer so that when a printing type element having a large printing surface is selected, the energizing forces of the two spring members are utilized to allow the printing hammer to strike the type element strongly, and when a type element having a small printing surface is selected, the energizing force of only one of the two spring member is utilized to allow the printing hammer to strike the type element less strongly.

12 Claims, 7 Drawing Figures

PRINTER

FIELD OF THE INVENTION

This invention relates to a printer in which both a ribbon lifting mechanism and a hammer operating mechanism having a hammer impact change-over mechanism are driven through a single clutch by an electric motor so that a selected printing type element is hammered to print the corresponding character on a printing sheet and to accomplish one printing cycle.

BACKGROUND OF THE INVENTION

In a conventional printer of this type, it is common to provide one electromagnet to engage the clutch for one printing cycle in response to a printing signal, and another electromagnet to operate the hammer impact change-over mechanism according to the size of the printing surface of a selected printing type element. Therefore, a change-over drive arrangement including these electromagnets must be provided that is both intricate in construction and costly to manufacture. These problems are compounded in a printer in which the ribbon lifting mechanism and the hammer operating mechanism are supported on a carrier movable along the printing line of the platen because the mechanisms on the carrier are large in size and weight.

In the hammer operating mechanism of a conventional printer, the energizing force of a first spring member having a large elastic force is applied to a cam follower member which is abutted against a cam member and is operatively coupled to the printing hammer. Where printing is being carried out with a printing type element having a large printing surface, the cam follower member is turned as the cam member rotates so that the printing hammer is operated to strongly strike the type element, i.e., printing is performed with large impact. On the other hand, where printing is carried out with a printing type element having a small printing surface, a switching operation is conducted by means of an electromagnet or the like so that the energizing force of a second spring member having a smaller elastic force is applied to the cam follower. The direction of the energizing force of the second spring member is opposite to that of the energizing force of the first spring member, with the result that the energizing force of the first spring member is decreased. Under this condition, the cam follower member is turned as the cam member rotates, so that the printing hammer is operated to strike the type element less strongly, i.e., printing is achieved with a weaker impact.

In the conventional printer designed as described above, the first spring member must be one having a large elastic force. Accordingly, components operatively coupled to the first spring member must be strong enough to withstand the large elastic force of the first spring member. This requires that the mechanisms of the printer to be heavy.

OBJECTS AND SUMMARY OF THE INVENTION

Accordingly, an object of this present invention is a printer in which the above-described difficulties accompanying conventional printers have been eliminated.

Another object of the present invention is a printer in which a single electromagnet is used for engaging the printing clutch for one printing cycle and for operating the hammer impact change-over mechanism in the hammer operating mechanism according to the size of the printing surface of a printing type element selected.

Still another object of the present invention is a printer in which the construction is simplified, the weight is reduced, and the manufacturing cost is decreased.

A further object of the present invention is a printer in which it is unnecessary to use spring members with large elastic forces and wherein spring members and components operatively coupled thereto can be simplified in construction and decreased in weight.

Yet another object of the present invention is a printer wherein the impact of the printing hammer can be positively changed according to the size of the printing surface of a printing type selected so that the printing operation is positively carried out.

These and other objects are achieved by an impact printer for forming images of selected print elements on a web comprising a first print element having a first type surface of a first area, a second print element having a second type surface of a second area smaller than the first area, a first biasing spring, a second biasing spring, and means adapted to receive a signal indicating the selection of said first print element for driving the first print element to impact the web with the combined force of the first and second biasing springs and a signal indicating the selection of the second print element for driving the second print element to impact the web with the force of only the first biasing spring.

BRIEF DESCRIPTION OF THE DRAWINGS

The foregoing and other objects, as well as the characteristic features of the present invention, will become more apparent from the following detailed description and the appended claims when read in conjunction with the accompanying drawings, in which like parts are designated by like reference numerals or characters, and wherein:

DETAILED DESCRIPTION OF THE PREFERRED EMBODIMENT

Figure 1:
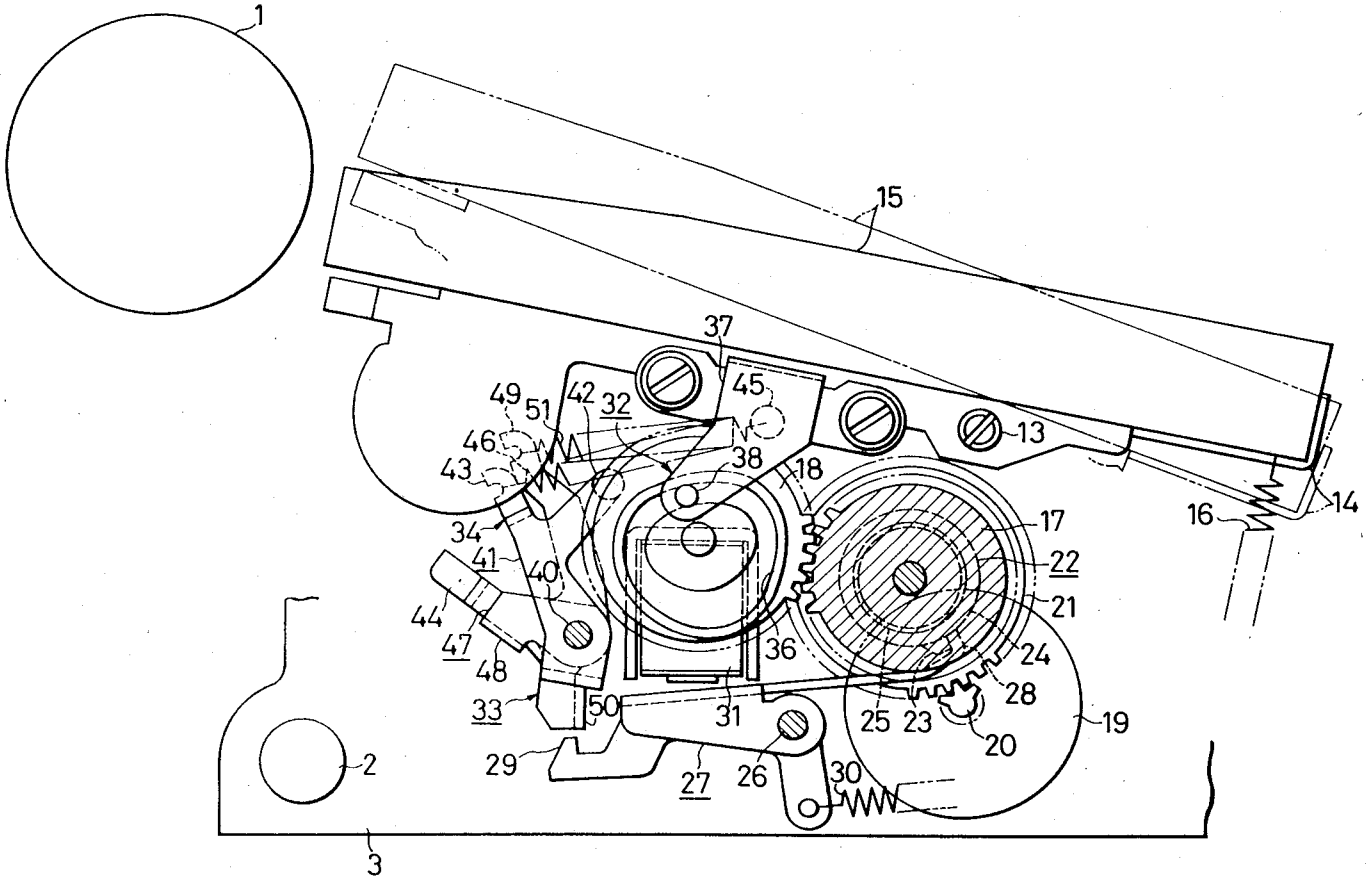
FIG. 1 is a side view showing essential components of a printer according to the present invention.
Figure 2:
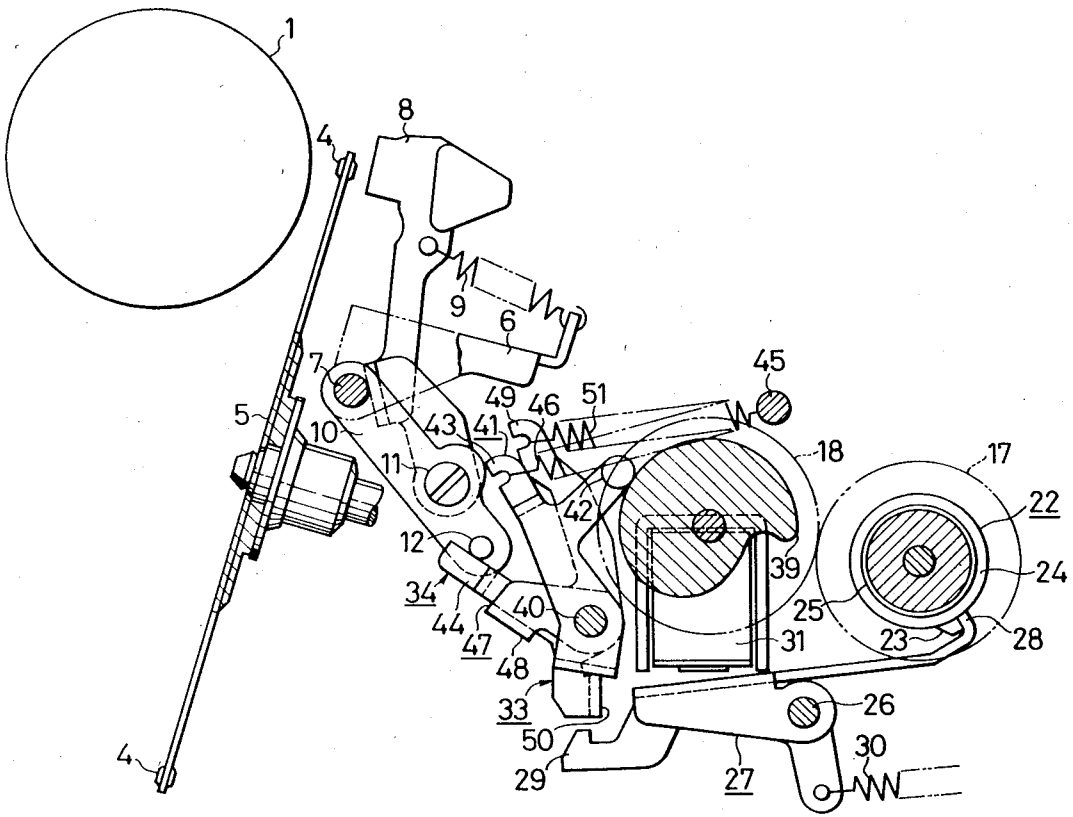
FIG. 2 is another side view showing essential components of the printer according to the present invention.

In the embodiment of the printer of the invention shown in FIG. 1, a platen 1 is rotatably supported on a frame (not shown), and a guide bar 2 is extended in parallel with the platen 1. A carrier 3 is movably supported by the guide bar 2. A printing head 5 having a number of printing type elements 4 on its peripheral surface as shown in FIG. 2 is rotatably provided on the carrier 3. In response to a printing signal, a selected printing type element 4 is positioned at a location corresponding to a printing line on the platen 1.

Figure 3:
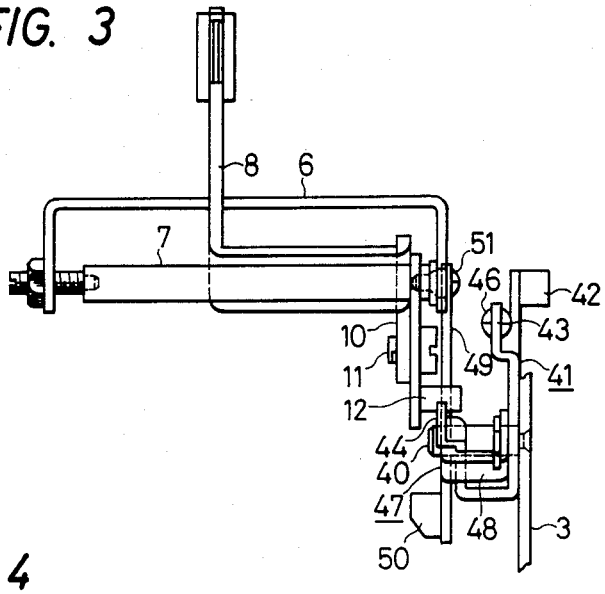
FIG. 3 is a bottom view of a hammer operating mechanism in the printer of the present invention.

As shown in FIGS. 2 and 3, a printing hammer 8 is rotatably supported through a hammer shaft 7 on the carrier 3 with the aid of a mounting plate 6. The printing hammer 8 is urged by a tension spring 9 so that normally it is held at a non-operating position as shown in FIG. 2. An operating lever 10 is fixedly secured to one end of the hammer shaft 7. The middle portion of the operating lever 10 is fixedly secured to one side leg of the printing hammer 8 with a screw 11.

A pin 12 protrudes from the lower end portion of the operating lever 10. When the pin 12 of the operating lever 10 is moved upwardly, the printing hammer 8 is rotated counterclockwise from the non-operating position shown in FIG. 2 to strike the rear side of the selected type element 4. This causes a selected character to be printed on the printing sheet on the platen 1.

As shown in FIG. 1, a cassette holder 14 is rotatably mounted on a supporting shaft 13 in the carrier 3. A ribbon cassette 15 is detachably placed on the cassette holder 14. The cassette holder 14 is biased by a tension spring 16 from the non-operating position (indicated by the solid line) to the operating position (indicated by the chain line) so that a part of the printing ribbon (not shown), extending from the ribbon cassette 15, is lifted to a position corresponding to the printing line on the platen 1.

Figure 5:
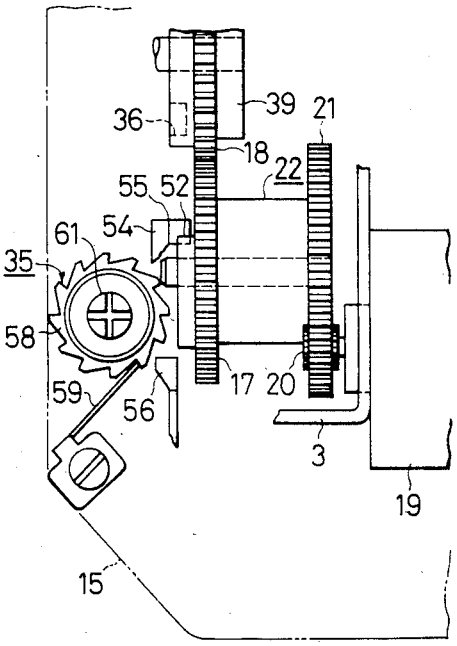
FIG. 5 is a plan view of the ribbon feeding mechanism of FIG. 4.

As shown in FIG. 1, 2, and 5, first and second gears 17 and 18 are rotatably supported on the carrier 3. The torque of a motor 19 on the carrier 3 is transmitted through a pinion 20, a transmission gear 21, and a clutch 22 to the first gear 17. The clutch 22 is designed so that when a clutch collar 24 is locked by a locking protrusion 23, a clutch spring 25 is released to disengage the clutch. When the locking of the clutch collar 24 is released, the clutch 22 is engaged by the action of the clutch spring 25.

As shown in FIGS. 1 and 2, a control member 27 is rotatably mounted on a supporting shaft 26 on the carrier 3. A locking pawl 28 is formed at one end of the control member 27 in such a manner that it is engaged with the locking protrusion 23 of the clutch 22, and an operating pawl 29 is formed at the other end of the control member 27. The control member 27 is urged by a tension spring 30 to engage the locking pawl 28 with the locking protrusion 23.

One electromagnet 31 is provided on the carrier 3 for the control member 27. When the electromagnet 31 is energized by a driver circuit 101 in response to the printing signal, the control member 27 is turned clockwise from the position as shown in FIGS. 1 and 2. As a result, the locking pawl 28 is disengaged from the locking protrusion 23 so that the clutch 22 is engaged to start one printing cycle.

The driver circuit 101 activates the electromagnet 31 differently in response to signal indicating the selection of a large type element (L) or a small type element (S). If a signal L is received by the driver circuit 101, the electromagnet is activated for a time period not exceeding the first half of a print cycle. If a signal S is received by the driver circuit 101, the electromagnet 31 is activated continuously for the first and second halves of a print cycle or, with the same effect, is activated at the beginning of each half of a print cycle.

As shown in FIGS. 1, 2, 4, and 5, a ribbon lifting mechanism 32 is provided between the second gear 18 and the cassette holder 14. A hammer operating mechanism 34 with a hammer impact change-over mechanism 33 is provided between the second gear 18 and the operating lever 10 of the printing hammer 8, and a ribbon feeding mechanism 35 is provided between the first gear 17 and the ribbon cassette 14.

First, the ribbon lifting mechanism 32 will be described. A ribbon lifting groove cam 36 is formed in the outside of the second gear 18. In correspondence to the groove cam 36, a driven arm 37 is fixedly secured to the side of the cassette holder 14. A driven pin 38 extends from the lower end portion of the arm 37 in such a manner that it is engaged with the groove cam 36. During a printing cycle started upon engagement of the clutch 22, the wide part of the groove cam 36 meets the driven pin 38 as the second gear 18 rotates, the cassette holder 14 is turned by the tension spring 16 from the position indicated by the solid line to the position indicated by the chain line. As a result, a part of the printing ribbon which is extended from the ribbon cassette 15 is lifted to a position corresponding to the printing line of the platen 1.

The hammer operating mechanism 34 will now be described in detail. As shown in FIG. 2, a cam member 39 for operating the printing hammer 8 in the second half of the printing cycle is provided on the inside surface of the second gear 18. In correspondence to the cam member 39, a cam follower member 41 is rotatably mounted on a supporting shaft 40 in the carrier 3. As shown in FIGS. 1 through 3, a contact pin 42 adapted to contact the peripheral surface of the cam member 39 and a spring hook 43 are provided at one end of the cam follower member 41. An engaging piece 44, adapted to engage with the pin 12 on the operating lever 10, is provided on the other end of the cam follower member 41.

A tension spring, namely a first spring member 46, is connected between the spring hook 43 of the cam follower member 41 and a pin 45 on the carrier 3 so that the contact pin 42 is pushed against the cam member 39. When the contact pin 42 reaches the minimum diameter part of the cam member 39 during the rotation of the member 39, the cam follower member 41 is rotated clockwise from the position shown in FIGS. 1 and 2, to move the pin 12 of the operating lever 10 upwardly.

A turning member 47 forming the hammer impact change-over mechanism 33 is rotatably mounted on the supporting shaft 40 of the cam follower member 41 at its middle portion. As shown in FIGS. 1 through 3, a first engaging part 48 engages the engaging piece 44 of the cam follower member 41 from below and a spring hook 49 is provided at one end of the turning member 47. A second engaging part 50 engageable with the operating pawl 29 of the control member 27 is formed at the other end. A second spring member 51 is connected between the spring hook 49 of the turning member 47 and the above-described pin 45 so that the first engaging part 48 of the turning member 47 is engaged with the engaging piece 44 of the cam follower member 41. Consequently, the cam follower member 41 is more strongly pushed against the cam member 39.

In the case where printing is carried out with a type element 4 having a small printing surface, the electromagnet 31 is energized by the driver circuit 101 until the second half of the printing cycle. The control member 27 causes the engagement of the operating pawl 29 and the second engaging part 50 to prevent the rotation of the turning member 47. The energizing force of the second spring member is made ineffective as a result.

Figure 4:
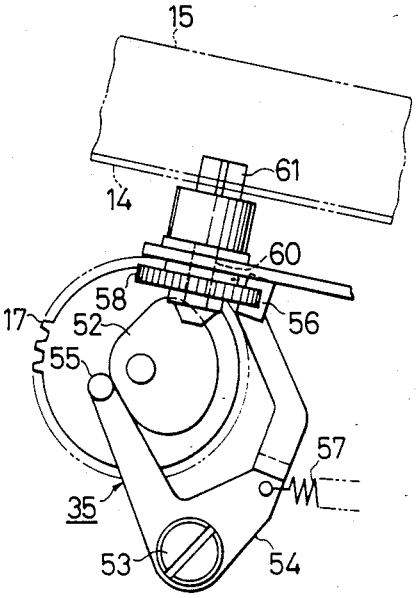
FIG. 4 is a side view showing a ribbon feeding mechanism in the printer of the present invention.

Next, the ribbon feeding mechanism 35 will be described in detail. As shown in FIGS. 4 and 5, a ribbon feeding cam 52 is provided on the outside of the first gear 17. In correspondence to the cam 52, a turning lever 54 is rotatably mounted by a stepped screw 53 on the carrier 3. A pin 55 contacting the peripheral surface of the cam 52 is provided on one end of the turning lever 54, and a ratchet 56 is provided on the other end.

The pin 55 is biased by a tension spring 57 so that it contacts the cam 52. A ratchet wheel 58, fixedly mounted on a rotary shaft 60, is supported in the carrier 3 to be rotatable only in one direction by means of a reverse rotation preventing piece 59. A joint 61 is provided on the upper end of the rotary shaft 60 in such a manner that it can go into the ribbon cassette 15 and engage with a ribbon feeding shaft (not shown). In one printing cycle, as the cam 52 rotates, the turning lever 54 is turned so that the ratchet wheel 58 is turned by the ratchet 56. The ribbon feeding shaft is thereby turned to feed the printing ribbon as required.

The operation of the printer thus constructed will be described.

When a type element having a large printing surface is selected, the corresponding printing signal L is applied to the driver circuit 101. As a consequence the electromagnet 31 is temporarily excited to turn the control member 27 clockwise from the position shown in FIG. 1 and to engage the clutch 22. The rotation of the motor 19 is transmitted to the first and second gears 17 and 18. As the first gear 17 is rotated, a predetermined length of the printing ribbon is extended from the ribbon cassette 15 by the ribbon feeding mechanism 35. On the other hand, as the second gear 18 is rotated, the casssette holder 14 is turned from the position indicated by the solid line in FIG. 1 to the position indicated by the chain line by the ribbon lifting mechanism. In this manner, the extended part of the printing ribbon is lifted to a position corresponding to the printing line of the platen 1.

Figure 6:
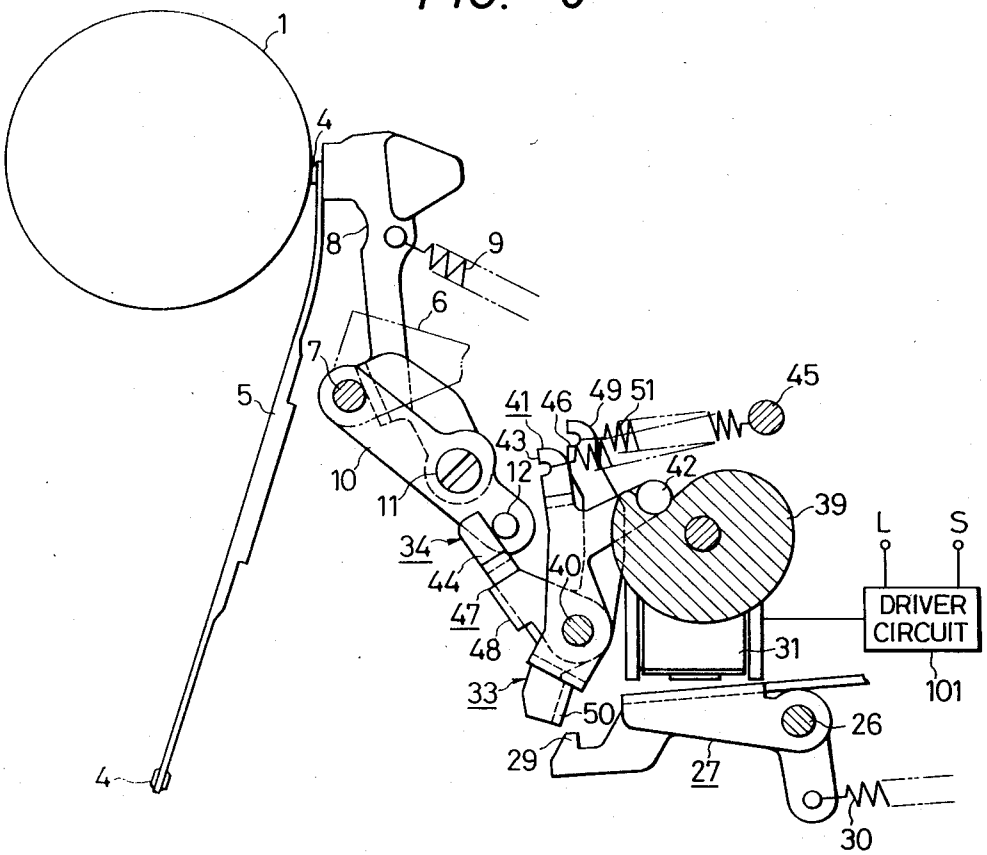
FIGS. 6 and 7 are side views illustrating the operation of the printer shown in FIG. 2.

In the printing cycle, as shown in FIG. 6, when the electromagnet 31 is deenergized by the driver circuit 101, the control member 27 is returned to its original position and the operating pawl 29 is disengaged from the second engaging part 50 of the turning member 47. Accordingly, when the contact pin 42 of the cam follower member 41 reaches the minimum diameter part of the cam member 39, the elastic force of the second spring member 51 which has been applied to the turning member 47 acts on the cam follower member 41 through the first engaging part 48.

As a consequence, the cam follower member 41 is turned clockwise from the position shown in FIGS. 1 and 2 by the spring members 46 and 51. This causes a strong torque to be applied to the pin 12 of the operating lever 10 by the engaging piece 44 of the cam follower member 41 so that the pin 12 is moved upwardly and the printing hammer 8 strongly strikes the rear surface of the selected type element having the large printing surface. Thus, a character image is printed on the printing sheet on the platen 1 by a strong impact.

Figure 7:
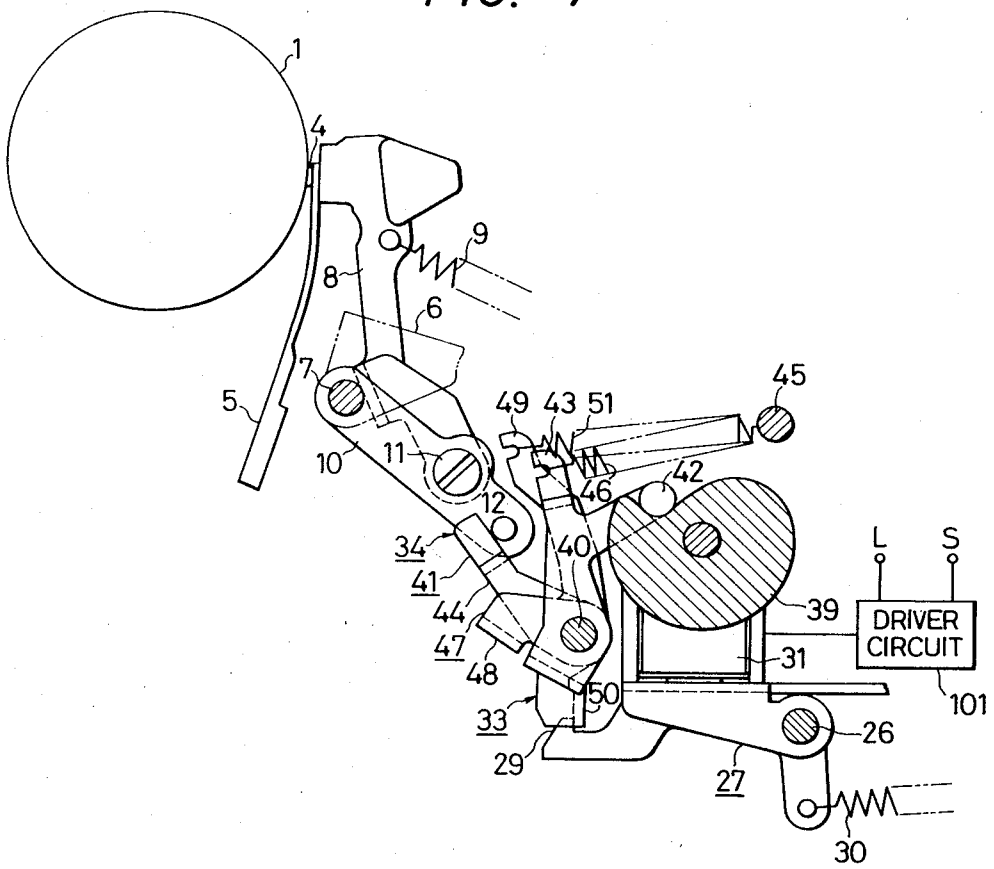

On the other hand, in the case where a type element 4 having a small printing surface is selected and the corresponding printing signal S is applied to the driver circuit 101 to control the electromagnet 31. The electromagnet 31 is maintained energized until the second half of the printing cycle. Therefore, even in the second half of the printing cycle, the control member 27 is held upward as shown in FIG. 7, and the operating pawl 29 is engaged with the second engaging part 50 of the turning member 47 so as to prevent the turning member 47 from being turned. Under this condition, when the contact pin 42 of the cam follower member 41 reaches the minimum diameter part of the cam member 39, the energizing force of the second spring member 51 for the cam follower member 41 is made ineffective and the cam follower member 41 is turned only by the action of the first spring member 46. As a result, the printing hammer 8 is operated by the operating lever 10 with a weaker impact so that the character is printed on the printing sheet on the platen by the selected type element having the small printing surface with a weaker impact.

While only one embodiment of the invention has been described in detail, it should be understood that the invention is not limited thereto or thereby and it will be obvious to those skilled in the art that various changes and modifications may be made without departing from the scope of the present invention. For instance, the printer may be modified so that in the case of using a type element with a small printing surface, instead of continuously energizing the electromagnet 31 until the second half of the printing cycle, the electromagnet may be deenergized after the start of the printing cycle and it is energized again in the second half of the printing cycle to make the energizing force of the second spring member 51 ineffective.

As is apparent from the above description, according to a first aspect of the present invention, it is unnecessary to use two electromagnets, namely, one electromagnet for engaging the printing clutch for one printing cycle and a different electromagnet for operating the hammer impact change-over mechanism in the hammer operating mechanism according to the size of the printing surface of type element being used. Thus, the invention has effects or merits that the printer can be simplified in construction, decreased in weight, and reduced in manufacturing cost.

Furthermore, according to a second aspect of the present invention, in the hammer impact change-over mechanism in the hammer operating mechanism, it is unnecessary to use a spring member having a strong elastic force, and yet the impact of the printing hammer can be positively changed according to the size of the printing surface of a type element to be used so that the printing operation may be positively carried out.

What is claimed is:

1. An impact printer for forming images of selected print elements on a web comprising:

a first print element having a first type surface of a first area;

a second print element having a second type surface of a second area that is smaller than said first area;

a print hammer for selectively striking said first and second print elements;

a primary print hammer driving mechanism for applying a first force to said print hammer in response to the selection of the second print element to cause said print hammer to strike said selected print element and to impart said web with said first force, said primary print hammer driving mechanism including a rotatable cam member having a cam surface with a print enable position, a rotatable cam follower member having one end for contacting said cam surface and another end coupled to said print hammer, and a first spring for exerting said first force on said cam follower member to bias said end of said cam follower member into contact with said cam surface, complete rotation of said cam member causing said end of said cam follower member to be positioned in said print enable position wherein said first force of said first spring is applied to said print hammer through said cam follower member; and a secondary spring hammer driving mechanism including a turning member having a first position in contact with a portion of said cam follower member and a second position not in contact with said portion of said cam follower member, a second spring for exerting a second force on said turning member to move said turning member into said first position to transmit said second force to said print hammer in addition to said first force when said end of said cam follower member is positioned in said print enable position, and a force limiting mechanism responsive to the selection of said second print element for positioning said turning member in said second position to prevent said second force from being applied to said print hammer whereby a greater force is applied to said print hammer responsive to the selection of said first print element than to the selection of said second print element.

2. An impact printer according to claim 1 wherein said force limiting mechanism comprises:

an operating pawl, and an electromagnet adapted to be energized in response to the selection of said second print element to move said operating pawl to engage said turning member and position said turning member in said second position.

3. An impact printer according to claim 2, further including a driving circuit for energizing said electromagnet only briefly at the start of the first half of a printing cycle responsive to the selection of said first print element to enable the driving of said print hammer with the combined forces of said first and second springs and for energizing said electromagnet during at least a portion of both the first and second halves of a printing cycle responsive to the selection of said second print element to enable the driving of said print hammer with only the force of said first spring.

4. An impact printer according to claim 3 wherein said driving circuit energizes said electromagnet continuously through said first and second halves of said print cycle responsive to said selection of said second print element.

5. An impact printer in which a ribbon lifting mechanism and a print hammer driving mechanism having a print hammer impact changing mechanism are driven through one clutch by an electric motor, said print hammer impact changing mechanism being operated in response to selection of one of large and small print elements of a print head, so that a selected printing character is typed on a printing web, thus accomplishing one printing cycle, the printer comprising:

an electromagnet;

a printing hammer;

a control member operated by said electromagnet to control engagement and disengagement of said clutch, said control member having an operating part which acts on said print hammer impact changing mechanism in association with the operation of said control member; and said print hammer driving mechanism having a cam member for operating said printing hammer in the second half of said printing cycle, and means to enable said electromagnet to be selectively operated in the second half of said printing cycle either by continuously operating said control member or to operate said control member a second time so that said print hammer impact changing mechanims is acted on by said operating part.

6. An impact printer according to claim 5 wherein said print hammer driving mechanism comprises:

a cam follower member rotatably supported at its middle part and has one end in contact with said cam member and the other end operatively coupled to said printing hammer;

a first spring member acting on said cam follower member so that one end of said cam follower member is pushed against said cam member and, when said one end of said cam follower member is brought into a minimum diameter portion of said cam member, said cam follower member is turned;

a turning member rotatably supported at its middle part, and having a first engaging part at one end thereof engageable with said cam follower member and a second engaging part at the other end engageable with said operating part of said control member; and a second spring member adapted to cause said first engaging part of said turning member to engage with said cam follower member, to thereby increase urging force of said cam follower member against said cam member, said second engaging part of said turning member being interlocked with said operating part of said control member when said control member is operated by selective energization of said electromagnet in the second half of said printing cycle, so that the biasing force of said second spring member with respect to said cam follower member is made ineffective.

7. An impact printer according to claim 6, further comprising:

a rotatable first gear;

a second gear rotatably engageable with said first gear;

a transmission for coupling said electric motor to said first gear;

a holder adapted to hold a ribbon cassette;

a lifting mechanism for lifting said holder during every print cycle such that said ribbon cassette therein is positioned in a printing position; and a ribbon feed mechanism for advancing a ribbon in said ribbon cassette in said holder following a print operation in a print cycle.

8. An impact printer according to claim 7 wherein said transmission comprises:

a pinion rotated by said motor;

a transmission gear engaged with said pinion for rotation therewith, said clutch transmitting the rotation of said transmission gear to said first gear; and a clutch spring for selectively disengaging said clutch from said transmission gear.

9. An impact printer according to claim 8, further comprising a locking pawl provided on one end of said control member;

a supporting shaft for rotatably supporting said control member;

a clutch collar on said clutch;

a locking protrusion on said clutch collar adapted for engagement with said locking pawl to lock said clutch; and a spring for rotating said control member such that said locking pawl engages said locking protrusion, said electromagnet selectively energizable to rotate said control member to disengage said locking pawl and said locking protrusion to unlock said clutch and to start a print cycle.

10. An impact printer according to claim 7 wherein said ribbon lifting mechanism comprises:

a groove cam on said second gear, said groove cam having a wide part;

a driven arm having a first end secured to said cassette holder and a second end;

a driven pin attached to said second end of said driven arm and having a portion received in said groove cam; and a spring for biasing said cassette holder into said printing position when said driven pin is positioned in said wide part of said groove cam during rotation of said second gear.

11. An impact printer according to claim 7 wherein said ribbon feed mechanism comprises:

a ribbon feeding cam on said first gear;

a rotatable turning lever having a first end and a second end;

a follower pin on said first end of said turning lever for engagement with the surface of said ribbon feeding cam;

a spring for biasing said follower pin to contact the surface of said ribbon feeding cam;

a rotatable ratchet wheel;

a pawl attached to said second end of said turning lever for rotating said ratchet wheel in accordance with rotation of said ribbon feeding cam on said rotatable first gear; and a shaft attached to said ratchet wheel for rotation therewith, said shaft adapted to engage and to rotate a ribbon feeding shaft in said ribbon cassette held in said holder.

12. An impact printer for forming printed images on a web by selectively impacting a ribbon against the web with either a first printing element having a first type surface of a first area or a second printing element having a second type surface of a second area that is smaller than the first area, the impact force of the first printing element being greater than the impact force of the second printing element, the printer comprising:

a print hammer for selectively striking the first print element or the second print element;

a print hammer driving mechanism including a rotatable cam member having a cam surface with a print enable position, a rotatable cam follower member having a first end for contacting said cam surface and a second end coupled to said print hammer, and a first biasing spring for applying a first force on said cam follower member to bias said first end of said cam follower member into contact with said cam surface, said first force being applied to said print hammer during each rotation of said cam member when said first end of said cam follower member is in contact with said print enable position of said cam surface, and a print hammer impact force changing mechanism for applying a second force to said print hammer through said cam follower member responsive to the selection of the first print element, the print hammer impact force changing mechanism comprising a rotatable turning member having a first position in contact with said cam follower member proximate said second end thereof and a second position not in contact with said cam follower member, a second spring for applying said second force to said turning member to rotate said turning member into said first position to transmit said second force to said print hammer, an operating pawl, and an electromagnet connected to said operating pawl and adapted to be energized in response to the selection of the second print element to engage said operating pawl and said turning member and to position said turning member in said second position.

* * * * *